United States Patent [19]

Gadway et al.

[11] Patent Number: 5,067,699

[45] Date of Patent: Nov. 26, 1991

[54] SHEET MATERIAL HANDLING APPARATUS WITH INSERTER ASSEMBLY

[75] Inventors: Jeffrey G. Gadway, Dayton; Robert Bryson, Sr., Huber Heights, both of Ohio

[73] Assignee: AM International Incorporated, Chicago, Ill.

[21] Appl. No.: 477,603

[22] Filed: Feb. 7, 1990

[51] Int. Cl.[5] ..... B65H 5/32

[52] U.S. Cl. ..... 270/55; 270/54; 270/57; 270/58; 270/1.1

[58] Field of Search ..... 270/53, 54, 55, 57, 270/58, 52, 52.5, 1.1

[56] References Cited

U.S. PATENT DOCUMENTS

| | | | |
|---|---|---|---|
| 3,059,391 | 10/1962 | Volks | 270/55 |
| 3,504,833 | 4/1970 | Faltin et al. . | |
| 3,608,888 | 9/1971 | McCain | 270/54 |
| 3,658,318 | 4/1972 | Bunting et al. . | |
| 3,819,173 | 6/1974 | Anderson | 270/54 |
| 3,897,051 | 7/1975 | Muller | 270/54 |

FOREIGN PATENT DOCUMENTS

| | | | |
|---|---|---|---|
| 967668 | 5/1975 | Canada | 270/54 |

OTHER PUBLICATIONS

"Pacesetter 850", by Harris Corporation/Bindery Systems Division published prior to Nov. 1, 1988.

*Primary Examiner*—Edward K. Look
*Assistant Examiner*—Therese M. Newholm
*Attorney, Agent, or Firm*—Tarolli, Sundheim & Covell

[57] ABSTRACT

A sheet material handling apparatus includes a main conveyor along which collated assemblies of signatures are sequentially moved. An inserter assembly is provided to feed inserts one-at-a-time into each of the collated signature assemblies in turn. The inserter assembly includes an infeed conveyor which feeds a continuous strip of interconnected inserts from a source. A separator assembly separates the leading insert from the remaining inserts in the strip of inserts. A separator conveyor moves the leading insert forwardly away from the strip of inserts toward a feeder conveyor. The feeder conveyor accelerates the insert to a relatively high speed and then propels the insert into an opening in the collated assembly of signatures. To form the opening in the collated assembly of signatures, a plow or deflector plate is mounted on the outer end portion of the feeder conveyor and engages the collated assembly of signatures.

21 Claims, 5 Drawing Sheets

SHEET MATERIAL HANDLING APPARATUS WITH INSERTER ASSEMBLY

BACKGROUND OF THE INVENTION

The present invention relates to a new and improved sheet material handling apparatus and method and, more specifically, to a sheet material handling apparatus and method in which an inserter assembly feeds inserts into collated assemblies of signatures disposed on a main conveyor.

A known sheet material handling apparatus includes a saddle conveyor having collecting (collating) stations which are sequentially moved past signature feed hoppers. The signatures are fed one at a time from each of the hoppers in turn onto the saddle conveyor to form a collated assembly of signatures at each of the collecting stations on the saddle conveyor. Typically, the collated assembly of signatures is stitched (stapled) at a stitching station. A loose card inserter is provided to insert subscription cards, advertising materials, or the like between selected pages of signature assemblies.

The signature supply hoppers, stitcher drive and other mechanisms are all disposed to one side, that is, the rear of the apparatus. One or more operators are provided at the rear of the apparatus to load signatures into the hoppers. In addition, the operators can perform other functions at the rear of the apparatus.

Typically, the loose card inserter is located at the front of the apparatus and its hopper must be filled on the order of thirty to thirty-five times or more per eight hour shift. In order to replenish the supply of loose cards in the loose card inserter, an operator must move to he loose card inserted in the front of the apparatus. This has been a problem. Frequently, replenishing the supply of loose cards has been overlooked, and thus signature assemblies do not receive a card when they should. Also, this has resulted in the provision of an operator to fill the loose card inserter at the front of the apparatus.

Also, typically a known loose card feeder is located adjacent the stitcher and has a relatively high profile. Since this known loose card feeder feeds separate cards individually from a hopper, it is subject to miss feeding and double feeding and thus it would be desirable to have a more reliable card feeder. The presence of the high profile loose card inserter makes it difficult for a operator to work on the stitcher. Also, since the known loose card feeders require separate individual cards to be supplied to its hopper, it is necessary to separate the cards from each other prior to the cards being located in the hopper of the card feeder.

SUMMARY OF THE INVENTION

The present invention minimizes the above-noted problems with the prior art. The present invention contemplates the storage of a very large number of card inserts so that the supply does not have to be replenished so often. In fact, the supply is such that it does not have to be replenished in an eight-hour shift. Further, the inserter of the present invention does not feed cards individually from a hopper. Thus, it is less likely than the prior art to have a miss feed or double-feed. Further, it is not necessary to provide the inserter with separate individual cards. Also, the inserter has a low profile and minimizes the interference with he accessibility of the operator to parts of the collating apparatus.

The inserter assembly of the present invention feeds an interconnected series of inserts toward a main conveyor, separates the leading insert from the series of inserts, and then feeds the leading insert into a collated assembly of signatures on the main conveyor. Thus, the inserter assembly includes a first or infeed conveyor assembly which feeds interconnected inserts from a supply. The inserter assembly includes a separator assembly which separates a leading insert from the remaining interconnected inserts.

When the leading insert has been separated from the remaining inserts, it is moved to a feed conveyor at a higher speed that the speed at which the remaining inserts are moving. The feed conveyor accelerates the leading inserts and propels it into the collated assembly of signatures on the main conveyor. A deflector or plow plate may be provided at the discharge end of the feed conveyor to open the collated assembly of signatures to receive the insert.

BRIEF DESCRIPTION OF THE DRAWINGS

The foregoing and other features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
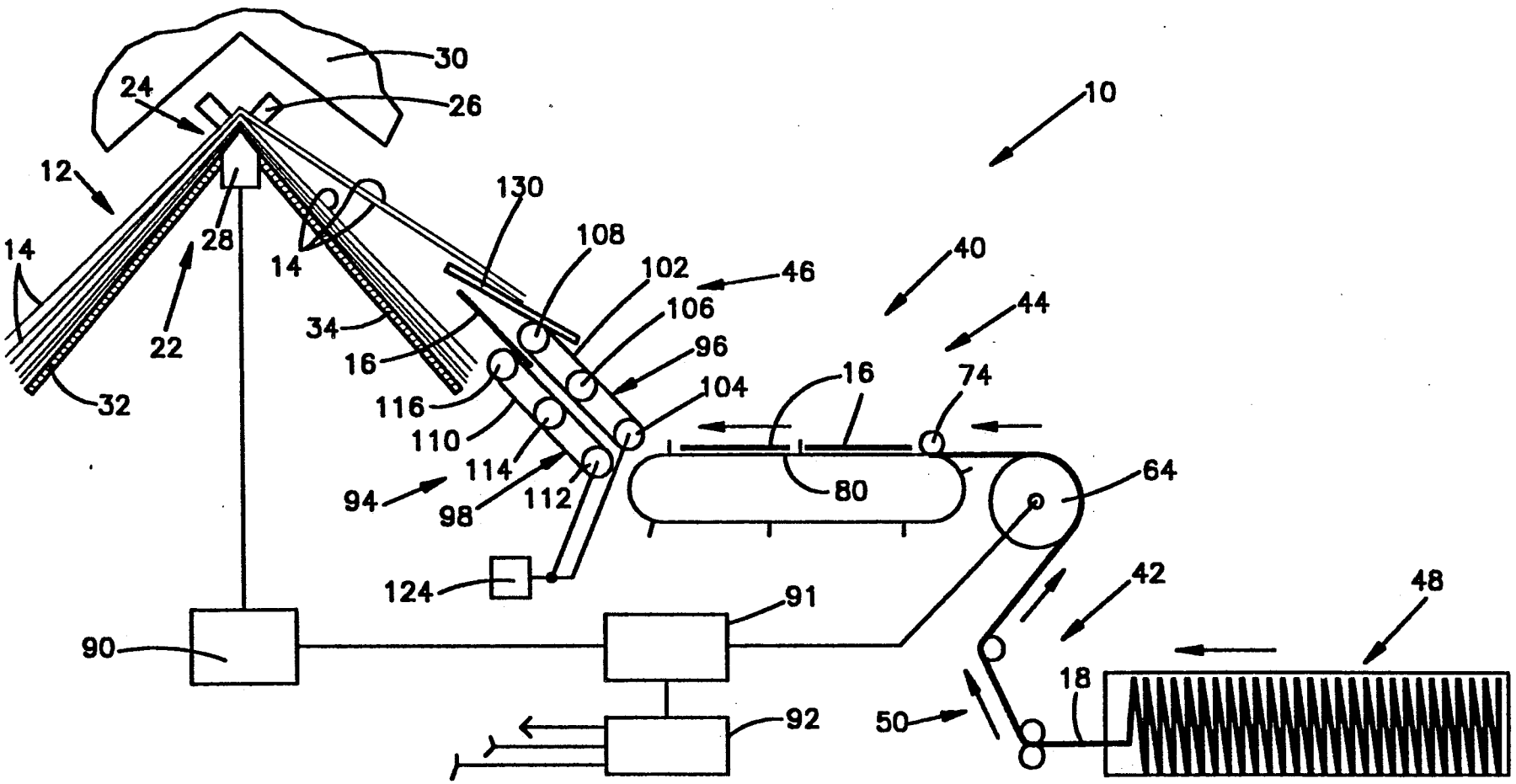
FIG. 1 is a schematic illustration of a sheet material handling apparatus constructed in accordance with the present invention and illustrating the relationship between a main conveyor which transports collated assemblies of signatures and an inserter assembly which feeds inserts from a series of interconnected inserts into the collated assemblies of signatures.

A sheet material handling apparatus 10 sequentially forms collated assemblies 12 of signatures 14. After the collated assemblies of signatures have been formed, one or more inserts 16 are sequentially positioned one-at-a-time or in multiples in each of the collated assemblies 12 of signatures. In accordance with a feature of the present invention, the inserts 16 are supplied from a strip or series 18 of interconnected inserts.

The sheet material handling apparatus 10 includes a saddle type main conveyor assembly 22 having a series of collating o signature receiving locations 24 disposed between pusher elements 26. The pusher elements 26 are connected with a conveyor chain 28. The main conveyor 22 is of the well known saddle type and includes a pair of side sections 32 and 34 which support the signatures 14 as they are moved along the side sections by the conveyor chain 28 past a linear array of signature supply hoppers and feed mechanisms 30.

The signature feed mechanisms 30 are operable to sequentially feed signatures to each of the collating locations 24 on the conveyor chain 28 as the collating locations move beneath the signature feed mechanisms. A stitcher assembly (not shown) is provided to stitch or staple the collated assemblies 12 of signatures 14 on-the-crown or peak of each of the collated assemblies of signatures. Each stitched collated assembly 12 of signatures is then sequentially moved to a trimmer which trims the edge portions of the collated assembly of signatures to the desired dimensions. Although the main conveyor assembly 22 and associated apparatus could have many different constructions, in one specific preferred embodiment of the invention, the main conveyor assembly 22 is a Harris Graphics Pacesetter 850 (Trademark) inserter-stitcher-trimmer which is commercially available from Harris Graphics Corporation, a division of AM International, of Dayton, Ohio.

An inserter assembly 40, constructed in accordance with the present invention, is operable to feed inserts 16 from the interconnected series or strip 18 of inserts into each of the collated assemblies 123 of signatures 14. Thus, the inserter assembly 40 includes an infeed conveyor section 42 through which the strip 18 of inserts is moved to a separator section 44. At the separator section 44, a leading insert 16 is separated or detached from the strip or series 18 of interconnected inserts. At a feed section 46 of the inserter assembly 40, the inserts are accelerated or propelled into the collated assemblies 12 of signatures 14.

In the embodiment of the invention illustrated in FIG. 1, a single insert assembly 40 is operable to feed inserts one-at-a-time into the collated assemblies 12 of signatures 14, However, a plurality of inserts could be fed at a time into each of the collated assemblies 12 of signatures 14 if desired. In addition, a plurality of inserter assemblies could be used to feed inserts into the collated assemblies 12 of signatures 14.

Since the inserts 16 are initially interconnected in a long series or strip, a large number of inserts can be provided at a supply section 48. The inserts 16 are folded in a zig-zag arrangement at the supply section 48 so that a very large number of inserts can be provided. In fact, a plurality of long strips or series 18 of interconnected inserts can be connected together when stored at the supply section 48 to supply the inserts required for operation of the apparatus 10 over a long period of time. This eliminates the necessity of restocking the supply of inserts 16 during operation of the sheet material handling apparatus 10 for an entire work shift.

Although it is preferred to store the inserts 16 in a zig-zag arrangement, the inserts can be stored in a different manner if desired. Thus, the interconnected inserts could be coiled on a roll or in a drum if desired.

The supply section 48 is at a lower level than the main conveyor 22 and lower edge portions of the signatures 14. This enables an operator to have an un obstructed view of the main conveyor 22. The supply section 48 is also positioned below the separator section 44 and feed section 46 to provide the operator with a clear view of these mechanisms. However, the supply section 48 could be disposed on the same level as the separator section 44 if desired.

The inserts 16 are formed of a single thickness of heavy paper or of lightweight card stock. The inserts are interconnected at transverse perforations which enable the cards to be disposed in a zig-zag arrangement with folds at the transverse perforations. This enables a very large number of cards to be supported on edge at the source or supply section 48.

An infeed conveyor 50 in the inserter assembly 40, pulls the web or strip 18 of interconnected inserts 16 from the supply 48 and moves them toward the main conveyor assembly 22 without breaking the perforated interconnection between the inserts. The strip 18 of interconnected inserts passes between a pair of guide rolls 54 and 56 (FIG. 2) through a drag unit 58, across a guide roller 62, to a pinwheel type feed roller 64. The feed roller 64 has pins which engage openings along one edge of the strip 18 of inserts to feed the strip 18 of inserts 16 forwardly, that is, toward the left as viewed in FIG. 2.

Figure 2:
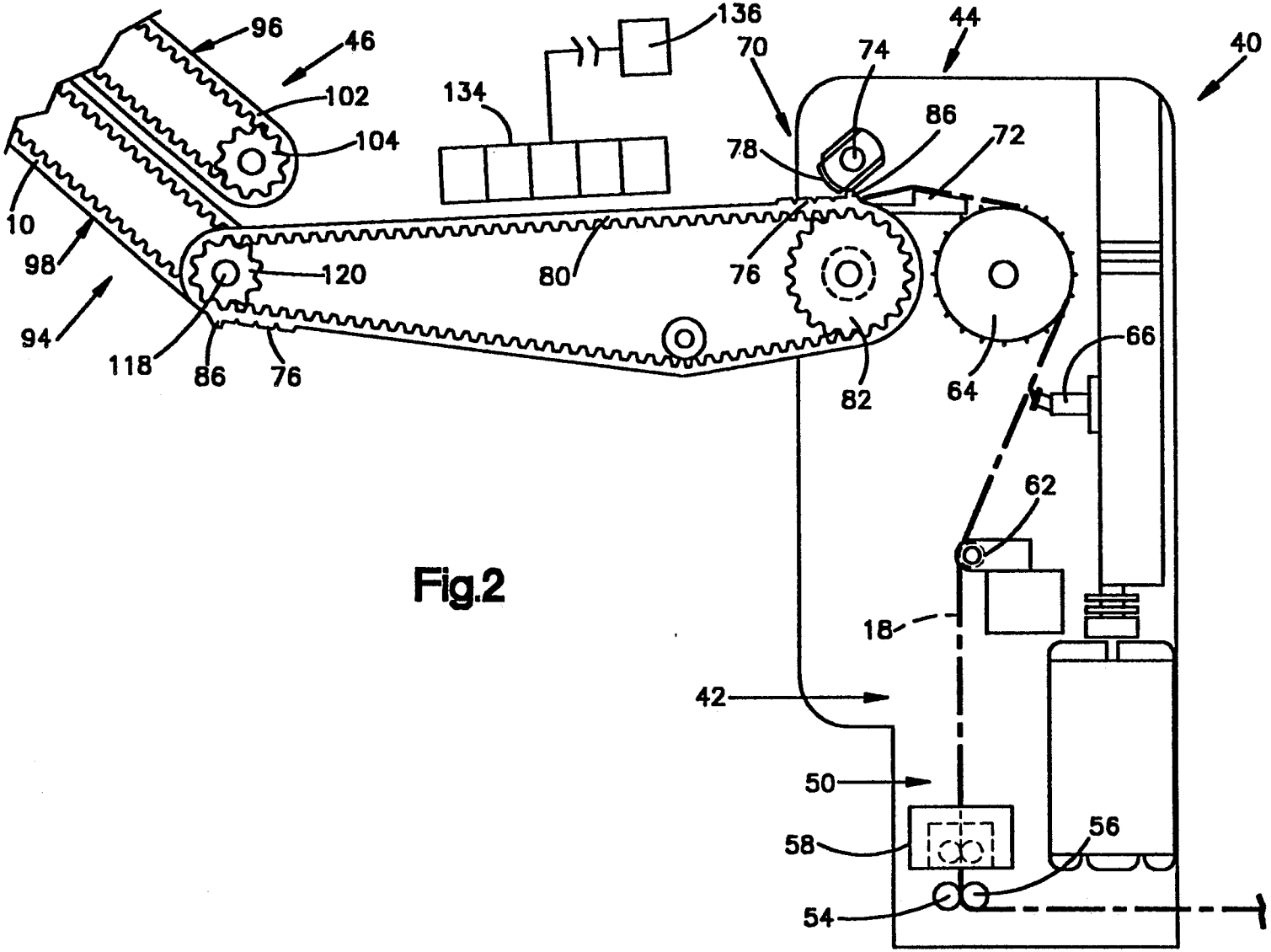
FIG. 2 is a somewhat schematicized and enlarged side elevational view of the inserter assembly.

An adhesive applicator 66 is shown in FIG. 2 to apply adhesive, if desired, to the inserts as they are moved by the feed conveyor 50. However, it is contemplated that the adhesive applicator 66 may not be used during the feeding of the inserts. Thus, it is believed that it will be desired to merely have the majority of the inserts 16 placed loosely in the collated assembly 12 of signatures without utilizing adhesive to hold the inserts in place. Of course, the adhesive applicator 66 could be used when it is desired to stick an insert in place in a collated assembly 12 of signatures.

The separator section 44 of the inserter assembly 40 includes a separator apparatus 70 which separates a leading insert 16 from the strip 18 of interconnected inserts. To separate the leading insert 16 from the strip 18 of inserts, the separator apparatus 70 ruptures the material between the perforations along a line which separates the trailing end of the leading insert from the other inserts in the strip 18. To initiate rupturing of the material between the perforations along the line separating the trailing end of an insert from the strip 18, the strip 18 is moved across a blade or ramp member 72. The stationary blade or ramp member 72 applies an upwardly directed force to a central portion of the strip 18 of inserts to cause the strip to be forced upwardly. This force is sufficient to initiate a rupturing of the material between the perforations at a central portion of the line of perforations disposed between the end of the leading insert 16 and the remainder of the inserts in the strip 18.

As the leading insert 16 in the strip 18 continues to move forwardly past the blade 72, it moves into a nip formed between a pair of bursting rollers 74 and thickened portions 76 of insert conveyor belts 80. The bursting rollers 74 have curved outer side surfaces 78 which are moved at a higher speed than the strip 18. The arcuate outer side surfaces 78 of the rollers 74 cooperate with the thickened portions 76 of the insert conveyor belts 80 to grip the trailing end portion of the leading insert. The rotation of the rollers 74 at a higher speed than the speed at which the strip 18 is moving causes the rollers to pull the leading insert 16 forwardly away from the strip 18. This completes the separation of the leading insert from the strip 18.

The insert conveyor belts 80 move at a surface speed which is greater than the speed at which the strip 18 is moved by the feed conveyor 50. Therefore, the separated insert 16 is accelerated to and transported at a speed which is greater than the speed of movement of the remaining inserts in the strip 18. This results in the establishment of a space between the separated leading insert 16 and the remaining inserts in the strip 18 of inserts.

To provide for the acceleration of a leading insert 16 immediately after it is separated from the strip 18, the insert conveyor belts 80 are driven at a higher speed than the surface speed of the pinwheel type feed roller 64 in the feed conveyor 50. The insert conveyor feed belts 80 are driven by a drive roller 82 which is driven at a higher speed than the pinwheel type feed roller 64. Although the conveyor belt drive roller 82 is driven at a higher speed than the pinwheel type feed roller 64, the drive roller 82 and feed roller 64 are driven by a common drive train.

Once the trailing end of a leading insert has been separated from the remaining inserts in the strip 18, ^ R pusher elements 86 connected with the insert conveyor belts 80 move into abutting engagement with the trailing end of the insert and push the insert toward the main conveyor 22. Since the insert conveyor belts 80 are moving at a higher speed than the strip 18 of interconnected inserts, the leading insert 16 which was just separated from the strip of interconnected inserts is moved away from the strip toward the feed section 46 at a speed which is greater than the speed of movement of the strip.

The infeed conveyor 50, insert conveyor belts 80 and main conveyor 22 (FIG. 1) are driven in a timed relationship with each other by a drive unit 90. Thus, the infeed conveyor 50, insert conveyor belts 80 and main conveyor assembly 22 are driven by the same power source. Therefore, a variation in the speed of movement of the main conveyor assembly 22 results in a corresponding variation in the speed of movement of the infeed conveyor 50 and insert conveyor belt 80.

An inhibit assembly 91 is operable to interrupt operation of the infeed conveyor 50 and insert conveyor belts 80 in response to any one of a plurality of operating conditions. The inhibit assembly 91 includes a clutch assembly and a brake assembly. When a detector unit 92 detects that anyone of a plurality of operating conditions are present, the clutch assembly is disengaged to interrupt the transmission of drive forces from the drive unit 90. At the same time, the brake assembly is engaged to stop operation of the infeed conveyor 50 and conveyor belts 80. The detector unit 92 has inputs from a plurality of sensors which detect various operating conditions, such as movement of a defective collated assembly 12 of signatures 14 to the inserter assembly 40, a failure of one or more devices along the main conveyor assembly 22 to operate properly, etc.

The construction and mode of operation of the infeed conveyor section 42 (FIG. 1) and separator section 44 of the inserter assembly 40 is similar to that disclosed in U.S. Pat. No. 3,504,833 issued Apr. 7, 1970 and entitled "Inserting Machine for High Speed Web Presses and the Like". Of course, the inserter assembly 40 could have a different construction than is shown in the aforementioned patent if desired.

The feed section 46 accelerates each of the inserts 16 in turn and propels the insert through space into a collated assembly 12 of signatures 14. The feed section 46 includes an insert feed conveyor 94. The insert feed conveyor 94 includes upper and lower conveyor sections 96 and 98 (FIG. 1) which extends upwardly from the separator section 44 in the manner shown in FIG. 3.

The upper conveyor section 96 includes a plurality of feed belts 102 (FIG. 2) which extend around a drive roller 104 and idler rollers 106 and 108 (FIG. 1). Similarly, the lower conveyor section 98 includes a plurality of feed belts 110 which extend around a drive roller 112 (FIG. 1) and idler rollers 114 and 116. Although the drive rollers 112 for the roller conveyor section 98 are mounted on a shaft 118 with an idler sprocket 120 for the insert conveyor belt 80 (FIG. 2), the drive rollers 112 for the belt 110 are driven separately from the insert conveyor belt 80 and the idler sprocket 120.

The upper and lower conveyor sections 96 and 98 of the feed conveyor 94 are both continuously driven by a drive motor 124 (FIGS. 1 and 3) at higher speeds than the insert conveyor belts 80. This enables the feed conveyor 94 to accelerate each of the inserts in turn as the leading end portion of the insert enters the nip between the upper and lower conveyor sections 96 and 98. Although the motor 124 has been shown in FIG. 3 as being disposed above the separator section 44, it is believed that it may be preferred to mount the motor below the feed section 46. By mounting the motor 124 below the feed section 46, access to the separator section 44 is improved and visual checking of the operation of the separator section is facilitated.

The speed to which an insert 16 is accelerated by the feed conveyor 94 is sufficient to cause the insert to fly through the air as it leaves the feed conveyor 94. This results in the insert 16 being propelled into a collated assembly of signatures 12 with sufficient force to frictionally wedge the leading end of the insert into the space between the signatures 14 at the backbone or crown of the collated assembly 12 of signatures 14. Therefore, the loose insert 16 is held in place in the collated assembly 12 of signatures.

When the trailing end of an insert 16 exits from the fed conveyor assembly 94, the leading end of the insert will be spaced from the signatures 14. After the insert 16 has moved through space for a short distance, the leading end of the insert engages the collated assembly 12 of signatures as they are being moved along the main conveyor 22 by the pusher elements 24 and 26. Since the leading end of the insert 16 engages the moving collated assembly 12 of signatures after the trailing end of the insert has exited from the fed conveyor assembly 98, the insert 16 is free to move with the collated assembly 12 of signatures. Therefore, the insert 16 is not skewed or otherwise retarded by engagement of the trailing end of the insert with the fed conveyor assembly 94 as the leading end of the insert engages the moving collated assembly 12 of signatures 14.

During operation of the inserter assembly 40, the speed of movement of an insert 16 increases in two distinct steps. Thus, when an insert 16 is being moved with the strip 18 of inserts by the infeed conveyor 50, the insert is moving at a first speed. After the insert 16 has been separated from the strip 18 of interconnected inserts, the insert is moved by the conveyor belts 80 at a second speed which s greater than the first speed. When the insert 16 has been engaged by the feed conveyor assembly 94, the insert is accelerated to a third speed which is greater than the second speed. The magnitude of the third speed is determined by the speed of operation of the motor 124. The motor 124 is continuously operated to drive the feed conveyor belts 102 and 110 at a greater speed than the insert conveyor belts 80.

Figure 3:
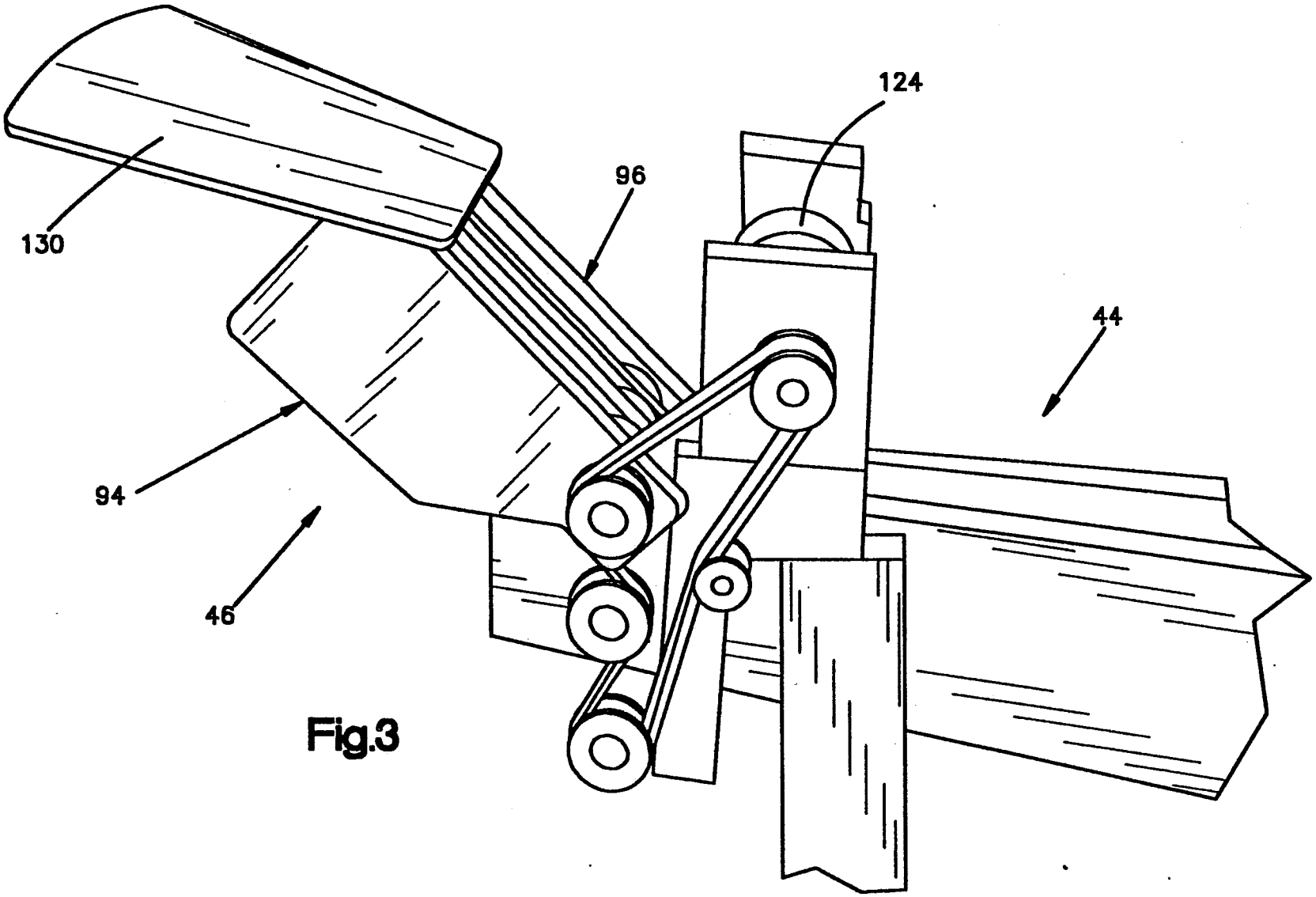
FIG. 3 is a pictorial illustration of an insert feed conveyor which feeds inserts separated from the interconnected series of inserts into collated assemblies of signatures on the main conveyor.

A deflector or plow plate 130 is mounted on the outer end portion of the feed conveyor assembly 94 (FIGS. 1 and 3). The plow or deflector plate 130 engages the signatures 14 (FIG. 1 to open the collated assembly 12 of signatures into which an insert 16 is to be fed. Although the plow or deflector plate 130 can be used to open the collated assembly 12 of signature at a random location as the collated assembly of signatures is being moved by the main conveyor assembly 22, it is believed that it will be preferred to have the collated assembly 12 of signatures opened at a preselected location. This can be done by using plow wires in a manner similar to hat described in U.S. Pat. No. 3,658,318 issued Apr. 25, 1972 and entitled "Method and Apparatus for Adding Loose Inserts to Magazines". Of course, the collated assembly 12 of signatures could be opened in other ways if desired.

An ink jet printer 134 (of known construction) is disposed above the conveyor belts 80 (FIG. 2) and is operable to print on each of the inserts 16 in turn. Thus, as the inserts 16 are being moved beneath the ink jet printer 134, controls 136 activate the ink jet printer to sequentially print indicia on the inserts. It should be understood that the ink jet printer 134 could be omitted if desired.

Figure 4:
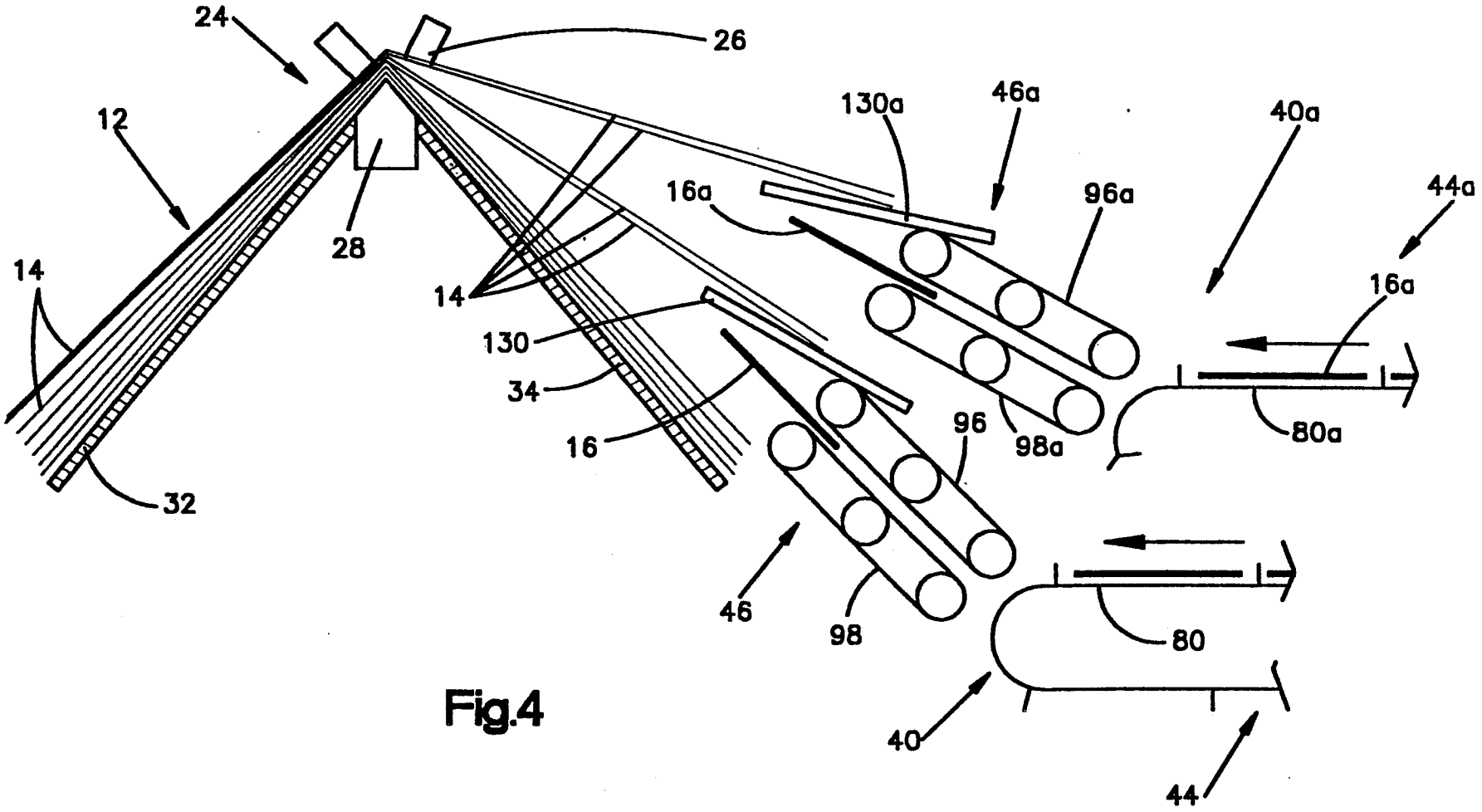
FIG. 4 is a schematic illustration of an embodiment of the invention in which a pair of inserter assemblies are used to feed inserts into collated assemblies of signatures.

In the embodiment of the invention illustrated in FIGS. 1 and 2, a single inserter assembly is used to sequentially feed inserts 16 into collated assemblies 12 of signatures. In the embodiment of the invention illustrated in FIG. 4, a plurality of inserter assemblies 40 and **40*a* are operable to feed a plurality of inserts 16 and 16*a* from a plurality of strips of inserts into each of the collated assemblies 12 of signatures 14. The inserter assemblies 40 and 40*a* can be operated to feed inserts 16 and 16*a* between the same pair of signatures 14 or to feed inserts between different pairs of signatures as illustrated in FIG. 4. The inserter assemblies 40 and 40*a* can be operated to sequentially feed the inserts 16 and 16*a*** or to simultaneously feed the inserts.

The inserter assembly **40*a* has the same construction and operates in the same manner as the inserter assembly 40. Thus, the inserter assembly 40*a* includes a separator section 44*a* where a leading insert 16*a* is separated or detached from a strip or series of interconnected inserts 16*a*. At a feed section 46*a*, the inserts 16*a* are accelerated or propelled into the collated assemblies 12** of signatures.

The insert conveyor feed belts **30*a* move the separated inserts 16*a* into the feed section 46*a*. In the feed section 46*a*, upper and lower conveyor sections 96*a* and 98*a* are continuously driven at higher speeds than the insert conveyor feed belts 80*a*. This enables the feed section 46*a* to accelerate each insert 16*a* in turn. The speed to which the inserts 16*a* are accelerated propels them through the air and frictionally wedges them in the space between the signatures 14**.

A deflector or plow plate **130*a* is mounted on the end portion of the feed conveyor assembly 94*a*. The plow 130*a* separates the signatures 14 to enable the inserts 16*a* to be fed in between a first or upper pair of signatures. The plow 130 separates the signatures 14 to enable the inserts 16 to be fed in between a second or lower pair of signatures. If desired, ink jet printers could be associated with each inserter assemblies 40 and 40*a*, in the manner shown in FIG. 2**.

Figure 5:
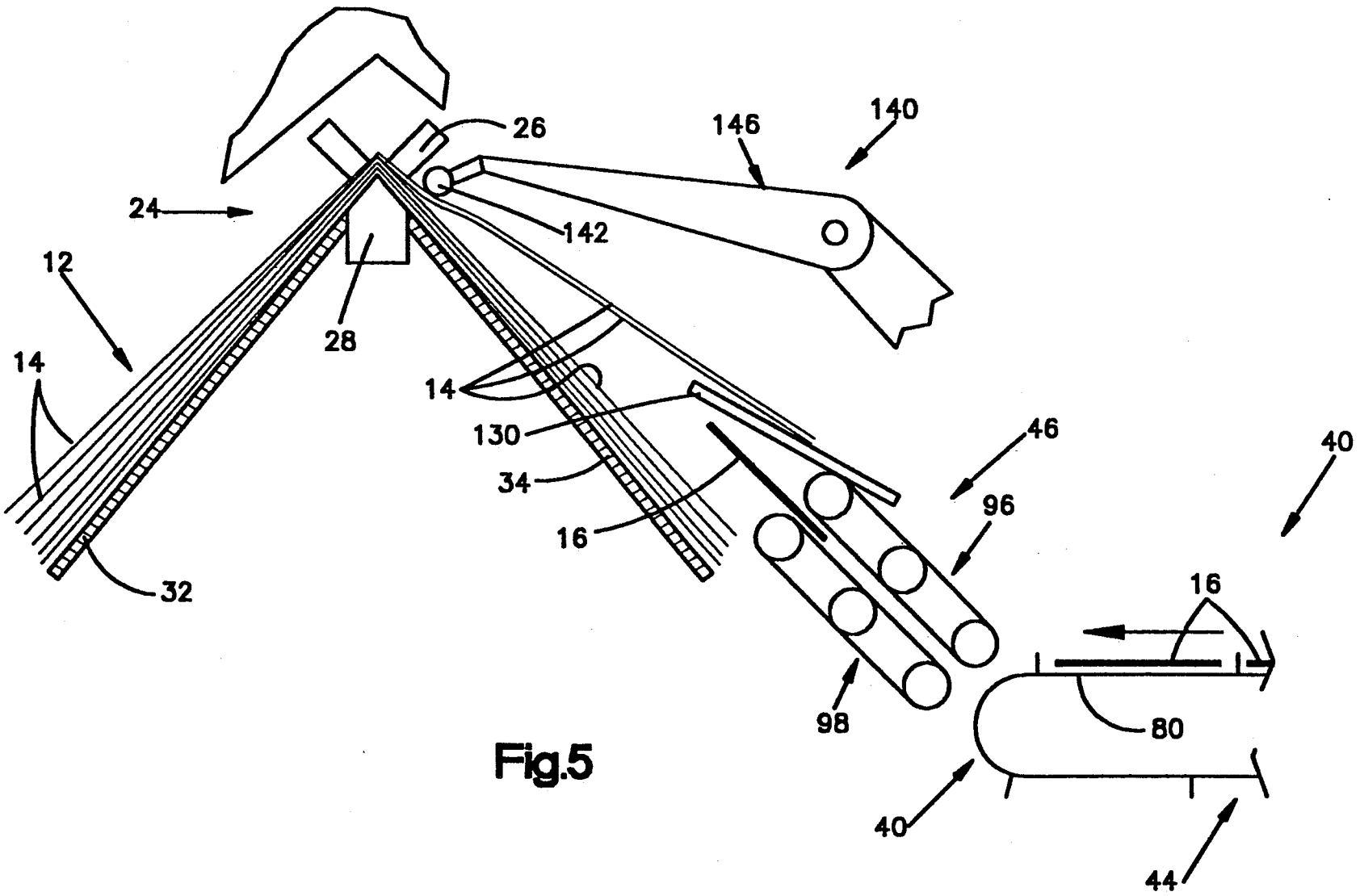
FIG. 5 is a schematic illustration of an embodiment of the invention in which a hold-down assembly presses against the outside of the collated assemblies of signatures.

In the embodiment of the invention illustrated in FIG. 5, a hold-down assembly is provided to promote gripping of the inserts 16 between the signatures 14. The hold-down assembly 140 includes a member or ski 142 which lightly presses the signatures 14 together. The force with which the inserts are propelled into the space between the signatures 14 is sufficient to move a leading end of an insert inwardly past the hold-down member 142. Once an insert has been fed into a collated assembly 12 of signatures, the hold-down assembly 140 presses the signatures 14 against the insert to hold the insert in place.

The hold-down member 142 is supported by an adjustable arm 146. The arm 146 is adjustable to change the location where the hold-down member 142 engages a collated assembly 12 of signatures 14. Thus, the hold-down member 142 can be moved toward or away from the peak or ridge of the saddle type main conveyor assembly 22. In addition, the pressure which the hold-down member 142 applies against the signatures 14 can be adjusted with the arm 146. The hold-down member 142 extends for a substantial distance along the main conveyor assembly 22 and has a longitudinal axis which is parallel to the peak or ridge of the main conveyor assembly 22.

In view of the foregoing description, it is believed to be clear that the present invention eliminates the necessity of having extra operators at the front of the apparatus 10 to load inserts into a loose card inserter. Instead of providing loose individual inserts, as in the prior art, the present invention contemplates that inserts 16 will be fed one-at-a-time or in multiples from a series 18 of interconnected inserts. By having the inserts 16 interconnected, a very large number of inserts, enough inserts to supply the apparatus 10 for a relatively long operating time, can be stored at the front of the apparatus.

The inserter assembly 40 feeds the interconnected series 18 of inserts toward a main conveyor assembly 22, separates the leading inserts 16 from the series 18 of inserts, and then feeds the leading insert into a collated assembly 12 of signatures on the main conveyor assembly. Thus, the inserter assembly 40 includes a first or infeed conveyor assembly 50 which feeds interconnected inserts from a supply or source. The inserter assembly 40 includes a separator assembly 44 which separates a leading insert 16 from the remaining interconnected inserts. When the leading insert 16 has been separated from the remaining inserts, it is moved to the feed conveyor assembly 94 at a higher speed than the speed at which the remaining inserts are being moved by the infeed conveyor 50. The feed conveyor assembly 94 accelerates the leading insert 16 and propels it into the collated assembly 12 of signatures 14 on the main conveyor assembly 22. A deflector or plow plate 130 is provided at the discharge end of the feeder conveyor assembly 94 to open the collated assembly 12 of signatures 14 t receive the insert 16.

Having described one specific preferred embodiment of the invention, the following is claimed:

1. An apparatus for feeding inserts from interconnected inserts into collated assemblies of signatures disposed on a main conveyor, said apparatus comprising means for feeding a plurality of interconnected inserts toward the main conveyor, means for separating a leading insert from the plurality of interconnected inserts as the plurality of interconnected inserts is being fed toward the main conveyor, means for separating one of the signatures in a collated assembly of signatures on the main conveyor from an adjacent signature, and means for feeding the leading insert which was separated from the plurality of inserts into the collated assembly of signatures at a location between the one signature and the adjacent signature while they are separated, wherein said means for feeding a plurality of interconnected inserts toward the main conveyor includes means for moving the plurality of interconnected inserts at a first speed, said means for separating a leading insert from the plurality of interconnected inserts includes means for accelerating the leading insert from the first speed to a second speed which is greater than the first speed, said means for feeding the leading insert into the collated assembly of signatures including means for accelerating the leading insert from the second speed to a third speed which is greater than the second speed.

2. An apparatus as set forth in claim 1 wherein said means for separating a leading insert from the plurality of interconnected inserts includes pulling means for engaging the leading insert and pulling the leading insert forwardly away from the remaining inserts of the plurality of interconnected inserts and insert conveyor means for moving the leading insert to said means for feeding the leading insert.

3. An apparatus as set forth in claim 1 further including means for feeding a second plurality of interconnected inserts toward the main conveyor, means for separating a leading insert from the second plurality of inserts as the second plurality of inserts is being fed toward the main conveyor, and means for feeding the leading insert which was separated from the second plurality of inserts into a collated assembly of signatures.

4. An apparatus for feeding inserts from interconnected inserts into collated assemblies of signatures disposed on a main conveyor, said apparatus comprising means for feeding a plurality of interconnected inserts toward the main conveyor, means for separating a leading insert from the plurality of interconnected inserts as the plurality of interconnected inserts is being fed toward the main conveyor, means for separating one of the signatures in a collated assembly of signatures on the main conveyor from an adjacent signature, and means for feeding the leading insert which was separated from the plurality of inserts into the collated assembly of signatures at a location between the one signature and the adjacent signature while they are separated, wherein said means for feeding the leading insert into the collated assembly of signatures includes an insert conveyor for propelling the leading insert through space into the collated assembly of signatures at the location between the one signature and the adjacent signature with a trailing end of the leading insert spaced apart from said insert conveyor when a leading end of the leading insert engages the collated assembly of signatures at the location between the one signature and the adjacent signature.

5. An apparatus as set forth in claim 4 wherein said means for separating a leading insert from the plurality of interconnected inserts includes means for moving the leading insert away from the remaining inserts of the plurality of interconnected inserts at a first speed which is a function of the speed of movement of the collated assembly of signatures by the main conveyor, said means for feeding the leading insert into the collated assembly of signatures including means for moving the leading insert at a second speed which is faster than the first speed and is independent of the speed of movement of the collated assembly of signatures by the main conveyor.

6. An apparatus as set forth in claim 5 further including printer means for printing indicia on an insert while the insert is moving at the first speed.

7. An apparatus as set forth in claim 4 wherein said means for separating one of the signatures in a collated assembly of signatures from an adjacent signature is mounted on an outer end portion of said insert conveyor.

8. An apparatus for feeding inserts from interconnected inserts into collated assemblies of signatures disposed on a main conveyor, said apparatus comprising means for feeding a plurality of interconnected inserts toward the main conveyor, means for separating a leading insert from the plurality of interconnected inserts as the plurality of interconnected inserts is being fed toward the main conveyor, means for separating one of the signatures in a collated assembly of signatures on the main conveyor from an adjacent signature, means for feeding the leading insert which was separated from the plurality of inserts into the collated assembly of signatures at a location between the one signature and the adjacent signatures while they are separated, and supply means for holding a supply of interconnected inserts, said supply means being disposed at a level which is below lower edges of signatures on the main conveyor.

9. An apparatus for feeding inserts from interconnected inserts into collated assemblies of signatures disposed on a main conveyor, said apparatus comprising means for feeding a plurality of interconnected inserts toward the main conveyor, means for separating a leading insert from the plurality of interconnected inserts as the plurality of interconnected inserts is being fed toward the main conveyor, means for separating one of the signatures in a collated assembly of signatures on the main conveyor from an adjacent signature, means for feeding the leading insert which was separated from the plurality of inserts into the collated assembly of signatures at a location between the one signature and the adjacent signature while they are separated, and hold-down means for pressing the signatures of the collated assemblies of signatures together, said means for feeding the leading insert into the collated assembly of signatures including means for feeding the leading insert into a collated assembly of signatures being pressed together by said hold-down means.

10. An apparatus as set forth in claim 9 further including hold-down means for pressing the signatures of the collated assemblies of signatures toward a portion of the main conveyor, said means for feeding the leading insert into the collated assembly of signatures including means for moving the insert between said hold-down means and the portion of the main conveyor.

11. An apparatus for feeding inserts from interconnected inserts into collated assemblies of signatures disposed on a main conveyor, said apparatus comprising means for feeding a plurality of interconnected inserts toward the main conveyor, means for separating a leading insert from the plurality of interconnected inserts as the plurality of interconnected inserts is being fed toward the main conveyor, means for separating one of the signatures in a collated assembly of signatures on the main conveyor from an adjacent signature, means for feeding the leading insert which was separated from the plurality of inserts into the collated assembly of signatures at a location between the one signature and the adjacent signature while they are separated, and printer means for printing indicia on inserts as the inserts are moving toward the main conveyor.

12. An apparatus for feeding inserts from interconnected inserts into collated assemblies of signature disposed on a main conveyor, said apparatus comprising means for feeding a plurality of interconnected inserts toward the main conveyor, means for separating a leading insert from the plurality of interconnected inserts as the plurality of interconnected inserts is being fed toward the main conveyor, means for separating one of the signatures in a collated assembly of signatures on the main conveyor from an adjacent signature, means for feeding the leading insert which was separated from the plurality of inserts into the collated assembly of signatures at a location between the one signature and the adjacent signature while they are separated, and inhibit means for interrupting operation of said means for feeding a plurality of interconnected inserts in response to a predetermined operating condition.

13. A method of feeding inserts from interconnected inserts into collated assemblies of signatures disposed on a main conveyor, said method comprising the steps of feeding a plurality of interconnected inserts toward the main conveyor, separating a leading insert from the plurality of interconnected inserts as the plurality of interconnected inserts is being fed toward the main conveyor, separating one of the signatures in a collated assembly of signatures on the main conveyor from an adjacent signature, and feeding the leading insert which was separated from the plurality of inserts into the collated assembly of signatures at a location between the one signature and the adjacent signature while they are separated, wherein said step of separating a leading insert from the plurality of interconnected inserts includes engaging the leading insert and pulling the leading insert forwardly away from the remaining inserts of the plurality of interconnected inserts.

14. A method as set forth in claim 13 wherein said step of feeding a plurality of interconnected inserts toward the main conveyor includes moving the plurality of interconnected inserts at a first speed, said step of separating a leading insert from the plurality of interconnected inserts includes accelerating the leading insert from the first speed to a second speed which is greater than the first speed, said step of feeding the leading insert into the collated assembly of signatures including accelerating the leading insert from the second speed to a third speed which is greater than the second speed.

15. A method as set forth in claim 13 wherein said step of separating a leading insert from the plurality of interconnected inserts includes moving the leading insert away from the remaining inserts of the plurality of interconnected inserts at a first speed which is a function of the speed of movement of the collated assembly of signatures by the main conveyor, said step of feeding the leading insert into the collated assembly of signatures including moving the leading insert at a second speed which is faster than the first speed and is independent of the speed of movement of the collated assembly of signatures by the main conveyor.

16. A method as set forth in claim 13 wherein said step of feeding the leading insert into the collated assembly of signatures includes propelling the leading insert through space into the collated assembly of signatures at the location between the one signature and the adjacent signature.

17. A method as set forth in claim 13 further including the steps of feeding a second plurality of interconnected inserts toward the main conveyor, separating a leading insert from the second plurality of inserts as the second plurality of inserts is being fed toward the main conveyor, and feeding the leading insert which was separated from the second plurality of inserts into a collated assembly of signatures.

18. A method as set forth in claim 13 further including the step of pressing the signatures of the collated assembly of signatures together, said step of feeding the leading insert into the collated assembly of signatures including feeding the leading insert into a collated assembly of signatures while pressing the signatures of the collated assembly of signatures together.

19. A method as set forth in claim 13 further including the step of pressing the collated assembly of signatures toward a portion of the main conveyor with a hold-down member, said step of feeding the leading insert into the collated assembly of signatures including moving the insert between the hold-down member and the portion of the main conveyor while pressing the collated assembly of signatures toward the portion of the main conveyor with the hold-down member.

20. A method as set forth in claim 13 further including the steps of printing indicia on the inserts as the inserts are being fed toward the main conveyor.

21. A method as set forth in claim 13 further including the step of interrupting the feeding of interconnected inserts toward the main conveyor in response to the occurrence of a predetermined operating condition.

* * * * *